US005298125A

United States Patent [19]

Fabbris

[11] Patent Number: 5,298,125

[45] Date of Patent: Mar. 29, 1994

[54] FLUID JET SUPPORTED HEADBOX

[75] Inventor: Renato Fabbris, Pinerolo, Italy

[73] Assignee: Beloit Technologies, Inc., Wilmington, Del.

[21] Appl. No.: 932,473

[22] Filed: Aug. 20, 1992

[30] Foreign Application Priority Data

Aug. 22, 1991 [EP] European Pat. Off. ..... 91630057.7

[51] Int. Cl.[5] ..... D21F 1/02

[52] U.S. Cl. ..... 162/336; 162/212; 162/344

[58] Field of Search ..... 162/336, 343, 299, 300, 162/322, 211, 212, 203, 351, 348, 344

[56] References Cited

U.S. PATENT DOCUMENTS

| | | | |
|---|---|---|---|
| 3,547,775 | 12/1970 | Bossen et al. | 162/342 |
| 3,619,362 | 11/1971 | Parker | 162/203 |
| 3,840,430 | 10/1974 | Ely | 162/343 |
| 4,070,238 | 1/1978 | Wahren | 162/343 |
| 4,294,655 | 10/1981 | Pfeffer | 162/322 |
| 4,683,027 | 7/1987 | Pitkajarvi | 162/336 |
| 4,684,441 | 8/1987 | Ibrahim | 162/198 |

FOREIGN PATENT DOCUMENTS

| | | |
|---|---|---|
| 3535944 | 5/1986 | Fed. Rep. of Germany . |
| 8710076 | 11/1988 | Fed. Rep. of Germany . |
| 1285579 | 8/1972 | United Kingdom . |

*Primary Examiner*—Karen M. Hastings
*Attorney, Agent, or Firm*—Dirk J. Veneman; Raymond W. Campbell; Gerald A. Mathews

[57] ABSTRACT

A structure and method for the improved formation and dewatering of a papermaking web onto a porous forming surface wherein a layer of water is first formed by depositing water onto a traveling wire and a stock slurry is deposited from a headbox slice onto the layer of water so that the layer of stock first interfaces with the water and improved fiber formation occurs onto the forming surface.

1 Claim, 1 Drawing Sheet

FLUID JET SUPPORTED HEADBOX

DESCRIPTION

Figure 1:
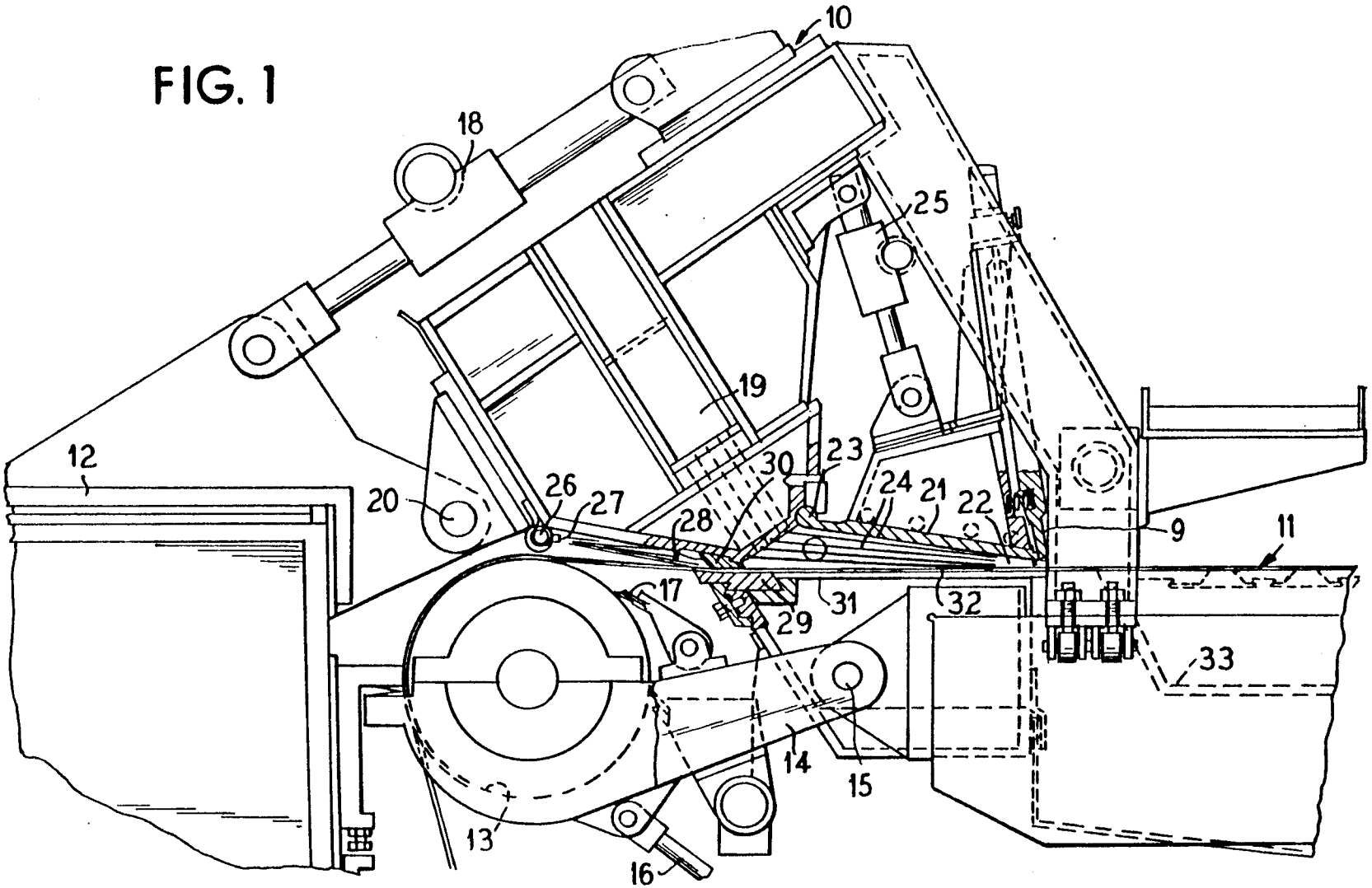

The present invention relates to improvements in papermaking machines, and more particularly to an improved method and apparatus for dewatering paper stock on a forming surface. More particularly, the invention relates to an improved method and apparatus for first depositing the slurry onto the traveling forming surface in a manner wherein fiber orientation and drainage of fibers and fines is controlled in the critical period during and immediately after the stock is deposited onto the forming wire.

A very critical step in the formation of paper web in a current high speed papermaking machine occurs when the jetstream of stock is first deposited onto the traveling forming wire. At that point in time, nonuniform deposit of the stream of stock from the headbox slice and undesirable differences in speed of the traveling forming surface and the layer of stock can substantially adversely affect the nature of the web which is formed.

As the initial lower surface of a stock stream first engages the wire, improper orientation of the fibers can occur and loss of fibers and fines will occur at that initial point in time. There is an initial contact between the fibers of the stock closest to the wire which can result in drainages of fibers through the wire. The location where the jet of stock is first deposited onto the wire is significant in that excessive pumping can occur closely following the breast roll resulting in a loss of fibers and also resulting in disorientation of the fibers.

It is highly desirable to obtain optimum circumstances at this location and efforts to avoid difficulties and improve formation at this point have been made. Such efforts include eliminating the free trajectory of the jet from the headbox slice and accurate control of the relative speeds of the wire and stock emitting from the headbox slice. If an improper relationship exists, the CD/MD quality of the paper can be adversely affected. Also, the web can be substantially nonuniform in an undesirable amount in comparing the wire side of the web with the upper side.

Another problem exists when multiple layered web is to be made and the headbox is structured so that the stock is delivered in layers with each layer having a different characteristic. It is essential that the layers retain their characteristics and that undesirable mixing of the layers does not occur and that the lower layer be properly formed on the traveling forming surface.

It is an object of the present invention to provide an improved structure and method for the smoother stock delivery from a headbox onto a traveling forming surface.

A further object of the invention is to provide an improved headbox arrangement capable of use with multiple layered stock wherein a better CD basis weight control is obtained and there is less tendency to have the layers mix when stratified.

A further object of the invention is to provide an improved headbox structure and stock delivery method wherein more uniform fiber orientation across the sheet occurs and better control of the CD/MD tensile ratio can be obtained.

A still further object of the invention is to provide an improved headbox stock delivery arrangement wherein higher retention of fibers and fines occurs particularly at the point of initial deposit of the layer of stock onto the traveling forming surface.

In accordance with the principles of the invention, the initial shock which occurs when stock emits from the headbox slice and engages the traveling forming wire is avoided with similar avoidance of the adverse effects. A layer of water is formed on the traveling forming surface, such as a fourdrinier wire, and the stock is deposited from the headbox slice to interface with the layer of water. Dewatering begins substantially immediately as the layer of water disappears through the forming surface but the initial shock and disorientation effects which occur with the stock directly engaging the traveling wire are avoided. The adverse effects of a relatively long free length of trajectory of the stock emitting from the headbox slice are also avoided by the stock being deposited directly onto the water layer. The water layer is deposited onto the wire upstream of the location where the stock engages the wire so that the first interface of the stock is with the layer of water rather than directly with the uneven surface of the traveling forming surface such as a fourdrinier wire.

ON THE DRAWINGS

Other objects, advantages and features will become more apparent with the teaching of the principles of the invention in connection with the disclosure of the preferred embodiments thereof in the specification, claims and drawings in which:

The single FIGURE of the drawings is a side-elevational view of a headbox and slice opening, shown partially in schematic and partially in section of a structure constructed and operating in accordance with the principles of the present invention.

As illustrated in the drawing, a headbox 10 is connected to receive a slurry of stock and the headbox is supported on a frame 12. The stock is deposited on a traveling forming surface, preferably in the form of a traveling fourdrinier wire 11.

The looped forming wire passes over a breast roll 13 supported on swing arms 14 at the ends pivoted at 15. A position control rod 16 locates the breast roll to position the wire at the beginning of the forming run. At the offrunning side of the breast roll where the wire leaves the roll at the upper end is a doctor blade 17.

The headbox is pivotally supported at 20 and a screw jack 18 raises or lowers the headbox to determine its location relative to the traveling forming wire 11.

Stock is delivered to internal header chambers such as 19 within the headbox and the stock under pressure travels down to a slice chamber having an upper movable chamber wall 21. Within the slice chamber are trailing floating elements 24 which continue to divide the multistrata of forming stock. The stock flows forward in multiple layers to be emitted at a slice opening 22. The chamber wall 21 is pivoted at 23 and the slice opening, defined by slice lip 9 on the upper side, and by the downstream end of support surface 31 on the lower side, is controlled by a screw jack 25 carried on the headbox.

As the stock is delivered onto the traveling forming wire, it is dewatered in a downward direction when the wire reaches a suction box 33 and usual dewatering elements follow the suction box in a downstream direction.

In accordance with the features of the invention, it is important that as the stock first engages the traveling dewatering wire 11, an excessive amount of fibers and fines are not immediately drained through the forming wire. It is also important that the random orientation of the fibers not be disturbed so that a CD/MD paper strength is not adversely affected. That is, the fibers should not become aligned either in a cross-machine or a machine direction to thereby weaken the paper in one direction.

In accordance with the invention, a layer of water is generated onto the wire so that the stock is delivered onto the wire first interfacing with the layer of water. This eliminates the highly disruptive effect which can occur by the stock first engaging the porous traveling wire 11.

To create this layer of water, a water slice 27 is provided extending across the machine supplied through a water supply conduit 26 in a manner so that a uniform thin layer of water is deposited onto the wire at 28 at substantially the same speed as the traveling forming wire 11. A lower ceramic wire guide 29 is positioned below the wire and an upper ceramic wire guide 30 is positioned above the lower guide to stabilize the wire. It is at the upstream location from these ceramic wire guides 29 and 30 that the slice stream of water at 28 is applied to the wire. A supporting surface 31 extends beyond the lower wire guide 29 to retain the sheet of water on the wire so that the sheet of water is intact at the location 32. Thus, when the layers of stock are deposited onto the forming surface, they first interface with the layer of water to stabilize and to avoid the shock of the first engagement which normally occurs between the stock and the wire. As soon as the layer of stock on the layer of water reaches the suction box 33, the water disappears through the wire so that standard formation and dewatering can immediately result. This, however, provides for an initial relatively gentle laying of the fibers onto the wire so that the amount of fibers and fines, which can frequently be lost in the normal procedure for depositing the stock slurry from the slice onto the fourdrinier wire are not lost but are retained. Preferably, the layer of water is less thick than the thickness of the slurry.

With this arrangement, by the stock first interfacing with the water layer, there is no shock which causes disruption of the fiber orientation. Also, the fiber orientation and retention of the multiple strata of stock is also retained. As the stock web continues to travel along on top of the forming wire, normal dewatering occurs with the formation of a web of paper having improved fiber orientation, and less loss of fibers on the lower surface. This, of course, insures a better CD basis weight control and less tendency of the layers to mix. If a stock is used with a single layer, the improved features are also utilized in that more uniform fiber orientation across the sheet length is attained. This makes it possible for easier control of the CD/MD tensile ratio.

Thus, it will be seen that there has been provided an improved apparatus and method of deposit of a slurry of stock onto a forming surface which meet the objectives and advantages above set forth. The advantages are attained without reconstruction or replacement of existing equipment and the arrangement to generate a sheet or a layer or water again be added to existing equipment without substantially adversely affecting the rate of formation and the rate of dewatering.

I claim:

1. A papermaking machine web forming structure comprising, in combination:

a single, substantially horizontally disposed, traveling fourdrinier wire having water drainage openings therein for dewatering a slurry of paper stock deposited on the surface thereof;

means, including a source of water, for creating a layer of water on the traveling fourdrinier wire;

and headbox means for delivering a layer of stock slurry onto the layer of water downstream of the location where the layer of water is created whereby the stock interfaces with the water layer and improved fiber formation on the fourdrinier wire occurs;

upper and lower stationary wire guides positioned opposite each other and structured and arranged to stabilize the fourdrinier wire, and positioned upstream from the location where the stock layer is deposited, said means for creating a layer of water being structured and arranged to deposit the layer of water between said wire guides, said upper guide positioned below the headbox and above the water layer, and said lower guide positioned beneath the fourdrinier wire.

* * * * *